US006397395B1

(12) United States Patent
DeHart

(10) Patent No.: US 6,397,395 B1
(45) **Date of Patent: *Jun. 4, 2002**

(54) HOODED GARMENT WITH STORABLE MASK OR GOGGLES

(76) Inventor: Anthony G. DeHart, 200 San Ramon Dr., San Jose, CA (US) 95111

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/409,476

(22) Filed: Oct. 6, 1999

(51) Int. Cl.[7] ..... A42B 1/18
(52) U.S. Cl. ..... 2/206; 2/202; 2/173
(58) Field of Search ..... 2/206, 173, 202, 2/171, 209.3, 209.11, 115, 84, 108, 207, 181.4, 203

(56) References Cited

U.S. PATENT DOCUMENTS

| | | | | | |
|---|---|---|---|---|---|
| 1,077,177 | A | | 10/1913 | Vagas et al. | |
| 1,097,530 | A | * | 5/1914 | Cabelinsky | 2/108 |
| 1,235,927 | A | | 8/1917 | Sanborn | |
| 1,309,783 | A | | 7/1919 | Slawin | |
| 1,650,258 | A | | 11/1927 | Bloomfield | |
| 2,439,382 | A | | 4/1948 | De Grazia | 2/84 |
| 2,500,982 | A | * | 3/1950 | Flgel | 2/84 |
| 2,581,366 | A | * | 1/1952 | Grazia | 2/203 |
| 3,271,781 | A | | 9/1966 | Sontag et al. | 2/202 |
| 3,287,737 | A | | 11/1966 | Schuessler | 2/206 |
| 3,292,182 | A | | 12/1966 | Schuessler | 2/173 |
| 3,307,202 | A | | 3/1967 | Schuessler | 2/173 |
| 3,561,010 | A | * | 2/1971 | Little | 2/173 |
| 3,717,882 | A | | 2/1973 | Schuessler | 2/173 |
| 3,740,767 | A | | 6/1973 | Schuessler | 2/173 |
| 3,747,124 | A | | 7/1973 | Zientara | 2/202 |
| 3,768,100 | A | | 10/1973 | Colman et al. | 2/9 |
| 3,789,839 | A | * | 2/1974 | Lund et al. | 128/142.7 |
| 4,095,290 | A | | 6/1978 | O'Brien | 2/9 |
| 4,300,240 | A | | 11/1981 | Edwards | 2/206 |
| 4,347,629 | A | * | 9/1982 | Itoi | 2/108 |
| 4,520,510 | A | | 6/1985 | Daigle | 2/452 |
| 4,589,408 | A | | 5/1986 | Singer | 128/132 R |
| 4,768,235 | A | * | 9/1988 | Webster | 2/205 |
| 4,811,430 | A | | 3/1989 | Janusz | 2/452 |
| 4,825,474 | A | | 5/1989 | Edwards | 2/206 |
| 4,941,211 | A | | 7/1990 | Blutstein | 2/202 |
| 5,035,004 | A | | 7/1991 | Koester | 2/206 |

(List continued on next page.)

*Primary Examiner*—John J. Calvert
*Assistant Examiner*—Alissa L. Hoey
(74) *Attorney, Agent, or Firm*—Haverstock & Owens LLP

(57) ABSTRACT

The hooded garment of the present invention has an integral, storable mask or goggles for use to protect the wearer against inclement weather, and particularly for use in outdoor cold weather sports, such as skiing or snowboarding. The mask has the shape of a filled-in, upside-down U. The edges of the U-shaped mask, with the exception of one to two inches on either end of the U is attached to the hood, preferably sewn. The mask attachment is preferably recessed from the hood opening but has the shape of the hood opening. When wearing the garment, the wearer has the option of wearing the mask or storing the mask flush against the inside, back of the hood. Further, the mask is versatile enough to keep as much or as little of the head, face, and neck of the wearer covered, as the wearer desires. The hood and mask can be worn loosely, or can be tightened by the drawstring of the hood. In an alternate embodiment, the mask comprises a horizontal separation, which runs across the middle of the mask. The horizontal separation allows the wearer to wear only the upper half of the mask over the eyes and nose of the wearer, to wear only the bottom half of the mask over the mouth of the wearer, or to wear both halves of the mask together over their entire face. The hood of the hooded garment and the mask preferably does not include cumbersome, and potentially dangerous, neck straps, Velcro, or too many drawstrings.

24 Claims, 8 Drawing Sheets

U.S. PATENT DOCUMENTS

| | | | | | |
|---|---|---|---|---|---|
| 5,067,174 | A | | 11/1991 | Ritchey et al. | 2/10 |
| 5,105,475 | A | | 4/1992 | Lynd et al. | 2/10 |
| 5,109,548 | A | | 5/1992 | Balaban et al. | 2/175 |
| 5,119,510 | A | * | 6/1992 | Schilling | 2/4 |
| 5,214,804 | A | | 6/1993 | Carey et al. | 2/206 |
| 5,251,336 | A | | 10/1993 | Nevins | 2/202 |
| 5,269,024 | A | | 12/1993 | Wyatt | 2/173 |
| 5,309,574 | A | | 5/1994 | Balaban et al. | 2/202 |
| 5,546,604 | A | | 8/1996 | Geller | 2/202 |
| 5,551,087 | A | | 9/1996 | Bluestein et al. | 2/173 |
| 5,575,009 | A | | 11/1996 | Ryvin | 2/173 |
| 5,664,259 | A | | 9/1997 | Budd | 2/115 |
| 5,713,077 | A | | 2/1998 | Humbrecht | 2/173 |
| 5,765,230 | A | | 6/1998 | Sivret et al. | 2/202 |
| 5,809,572 | A | | 9/1998 | Sisolak | 2/173 |
| 5,845,340 | A | | 12/1998 | Frislie | 2/202 |

* cited by examiner

HOODED GARMENT WITH STORABLE MASK OR GOGGLES

FIELD OF THE INVENTION

The present invention relates to the field of hooded garments having storable masks or goggles for use against inclement weather, and particularly for use in outdoor cold weather sports, such as skiing or snowboarding.

BACKGROUND OF THE INVENTION

The present invention relates generally to protective head gear, including caps, ski caps, hats, headbands, and visors. The present invention also relates generally to cold weather garments, particularly coats, jackets, sweatshirts, and other similar outerwear having integral or removable head coverings or hoods.

Generally, the masks that are an integral part of protective head gear and hoods are not versatile enough. For example, too little of the head, face, and neck are protected. As taught in U.S. Pat. No. 2,292,182 by Schuessler, the cap includes material that folds down in the back of the head that keeps the neck and ears of the wearer warm. Similarly, the ski caps taught in U.S. Pat. No. 3,292,182 by Schuessler and U.S. Pat. No. 5,309,574 by Balaban have masks that fold out from the edges of the cap in the back of the head of the wearer and cover only the cheeks, mouth, and chin of the wearer. Many conventional masks that sufficiently cover the head, face, and neck of the wearer do not allow for convenient storage when not in use. The mask taught in U.S. Pat. No. 5,713,077 by Humbrecht is attached to the top of section of the opening of a hood, and the front portion of the hood contains the. rolled up face mask when the mask is not in use. Another prior art mask taught in U.S. Pat. No. 3,717,882 by Schuessler is basically a mask for the entire head, which leaves the wearer only the options of wearing the entire head mask or wearing no mask. U.S. Pat. No. 5,551,087 by Blutstein and U.S. Pat. No. 5,809,572 by Sisolak both teach a hat and a hood and include face masks which do not roll up inside the hat or hood. These two masks are both oval in shape and are completely sewn into the hat or hood, and thus may as well be masks for the entire head.

Generally, the masks that are not an integral part of protective head gear and hoods are also not convenient by virtue of being two separate pieces. A garment and hood, which are two separate pieces, are taught in U.S. Pat. No. 5,765,230 by Sivret et al. In this reference, the hood is used as a hood, face shield, and neck tube. However, this garment and hood combination requires the use of many drawstrings. The hood as taught in U.S. Pat. No. 5,546,604 by Geller includes a detachable face mask. This mask is not storable, such that the wearer must keep track of the mask. Similarly, in both U.S. Pat. No. 5,035,004 by Koester and U.S. Pat. No. 5,713,077 by Humbrecht, Velcro is used to attach masks to both a cap and a hood, again keeping the masks separate from both the cap and the hood. This is inconvenient for the wearer.

The masks taught in U.S. Pat. Nos. 5,035,004 by Koester and 5,546,604 by Geller both completely cover the face of the wearer and are made of mesh. This mask is not warm enough for a wearer in inclement weather. The purpose of the mask by Koester is for protection against insects. The purpose of the mask by Geller is to protect the identity of the wearer.

Further, some of the masks within the prior art, such as U.S. Pat. No. 5,845,340 by Frislie, include neck straps to keep the neck of the mask secure. These neck straps are cumbersome and can be dangerous for young wearers.

Headgear with integral goggles is also taught within the prior art. U.S. Pat. No. 4,811,430 by Janusz teaches a headband, which uses Velcro to hold transparent or shaded eyeglass material in place against the bridge of the nose of the wearer. This reference also teaches a pocket in the headband into which the eyeglass material can be stored. Similarly, U.S. Pat. No. 4,520,510 by Daigle teaches a headband, which contains eye openings, over which transparent or shaded eyeglass material can be held in place with Velcro. A visor held by a headband is taught in U.S. Pat. No. 5,067,174 by Ritchey et al. This visor has plastic glasses fastened at the pivot points above the ears of the wearer on the headband. None of the references in the prior art, however, combine goggles with a protective headgear or hood.

Therefore, a protective headgear or hood is needed that is integral with a storable mask for convenience of the wearer. Further, a protective headgear or hood integral with a storable mask is needed that is versatile enough to keep as much or as little of the head, face, and neck of the wearer covered, as the wearer desires. Still further, a protective headgear or hood integral with a storable mask is needed such that the storable mask stores well inside the headgear or hood, when the mask is not in use by the wearer. Also, a protective headgear or hood is needed that is integral with goggles.

SUMMARY OF THE INVENTION

The hooded garment of the present invention has an integral, storable mask or goggles for use to protect the wearer against inclement weather, and particularly for use in outdoor cold weather sports, such as skiing or snowboarding. The mask has the shape of a filled-in, upside-down U. The edges of the U-shaped mask, with the exception of one to two inches on either end of the U, is attached to the hood, preferably sewn. The mask attachment is preferably recessed from the hood opening but has the shape of the hood opening. When wearing the garment, the wearer has the option of wearing the mask or storing the mask flush against the inside, back of the hood. Further, the mask is versatile enough to keep as much or as little of the head, face, and neck of the wearer covered, as the wearer desires. The hood and mask can be worn loosely, or can be tightened by the drawstring of the hood. In an alternate embodiment, the mask comprises a horizontal separation, which runs across the middle of the mask. The horizontal separation allows the wearer to wear only the upper half of the mask over the eyes and nose of the wearer, to wear only the bottom half of the mask over the mouth of the wearer, or to wear both halves of the mask together over their entire face. The hood of the hooded garment and the mask preferably does not include cumbersome, and potentially dangerous, neck straps, Velcro, or too many drawstrings.

DETAILED DESCRIPTION OF THE PREFERRED EMBODIMENT

Figure 1:
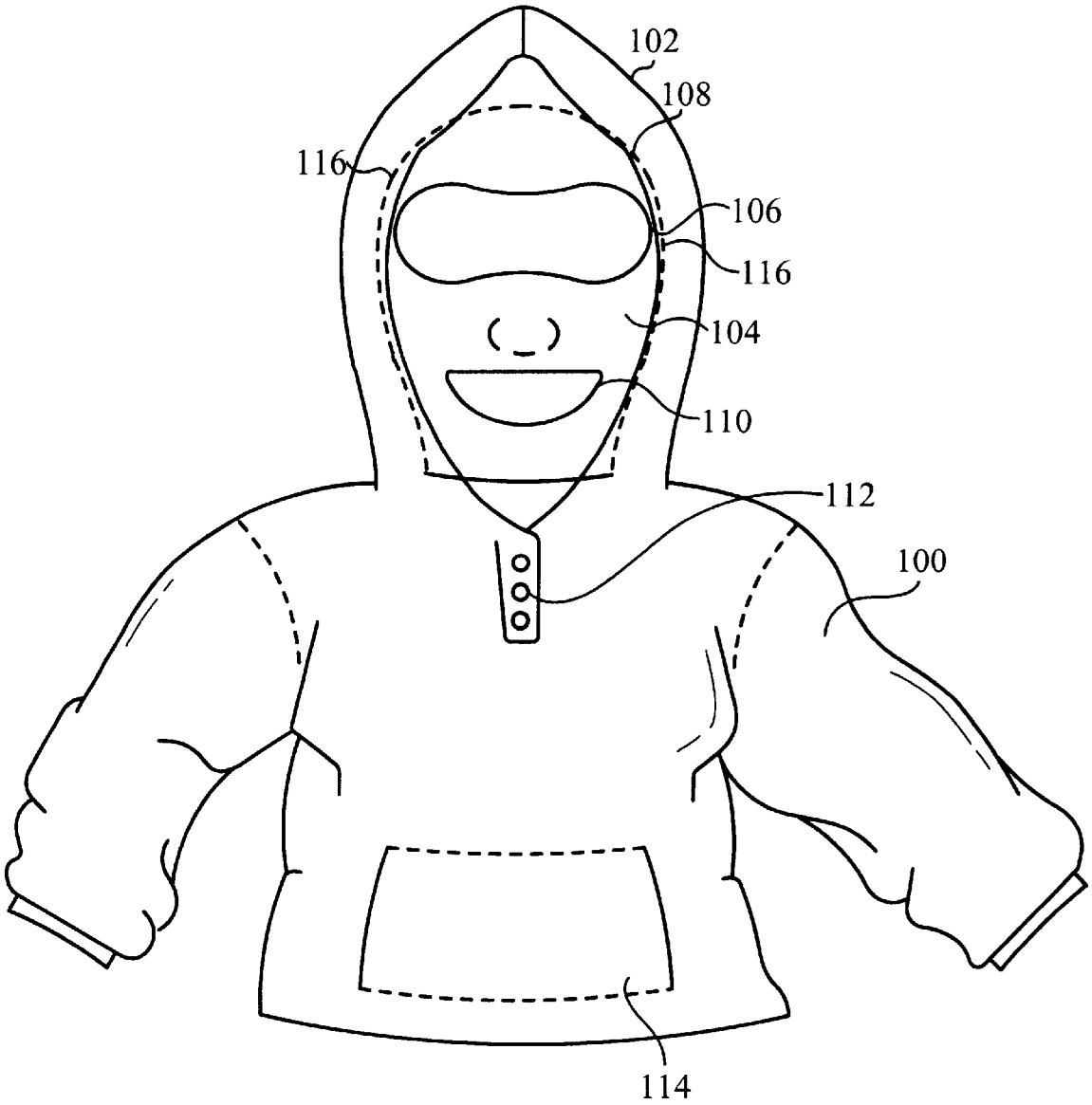
FIG. 1 illustrates a front view of the hooded garment with a storable mask, while the wearer has on the storable mask.

FIG. 1 illustrates a front view of a hooded garment with a storable mask, while the wearer has on the storable mask. The hooded garment 100 has a loose-fitting hood 102, and a button-up neck 112. In an alternative embodiment, the neck is solid material without buttons. The hooded garment 100 also preferably has one large pocket 114 centered in the lower front of the hooded garment. The large pocket 114 has two openings into which the hands of the wearer can be placed. The storable mask 104 is fastened to the inner surface of the hooded garment hood 102, as shown by the stitching 108. In the preferred embodiment, the storable mask is sewn into an inner lining within the hood. The storable mask preferably has the shape of a filled-in, upside-down U. The edges of the U-shaped mask are sewn into the hood with the exception of the last one to two inches at either end of the U, near the neck of the wearer at the bottom of the hood. The mask attachment 104 is recessed from the hood opening and preferably has the shape of the hood opening. This recess allows the hood to protrude over the face of the wearer to protect the wearer from inclement weather. The storable mask 104 preferably has an opening 106 out of which the wearer can see with both eyes. In an alternative embodiment, the storable mask 104 has an opening 110 for the mouth of the wearer. Alternatively, instead of the storable mask, the hooded garment has storable goggles, also fastened to the inner surface of the hood at two points along the stitching line 108 at the points 116.

Figure 8:
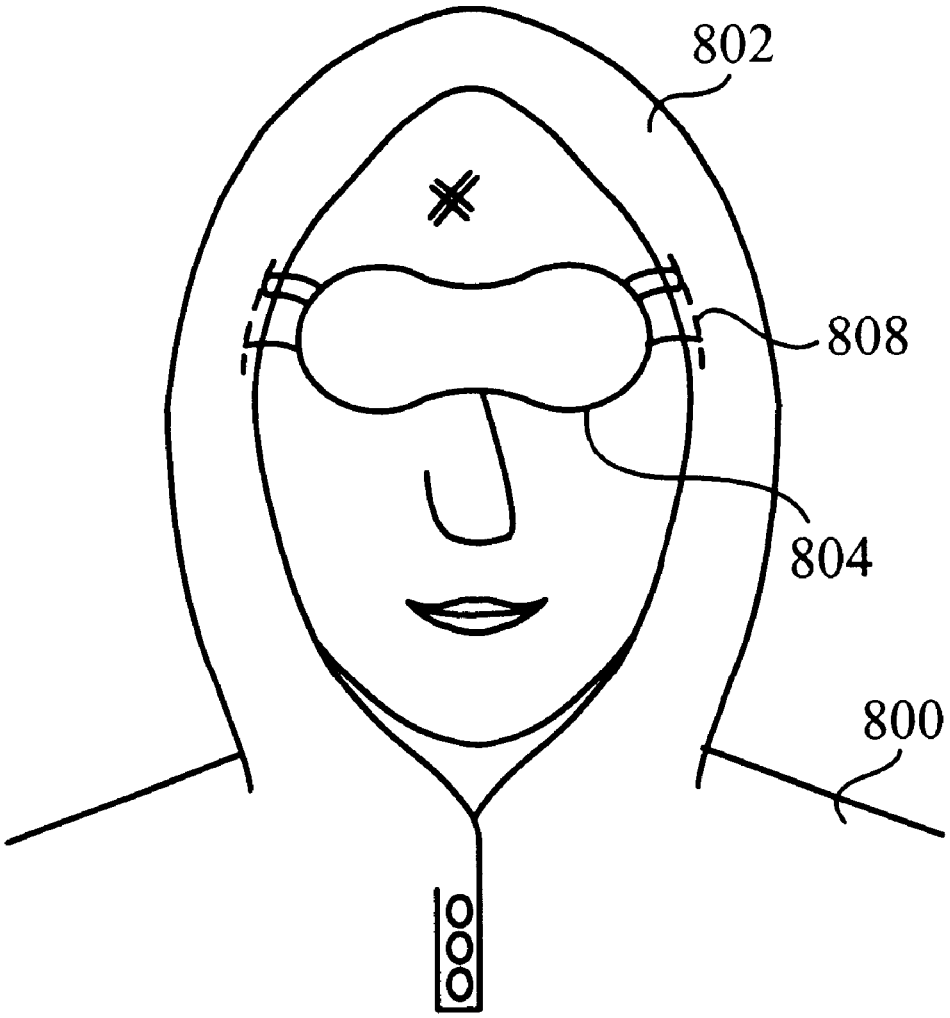
FIG. 8 illustrates a partial front view of the hooded garment with goggles, while the wearer has on the goggles.

FIG. 8 illustrates a partial front view of the hooded garment with goggles, while the wearer has on the goggles. The hood 802 of the hooded garment 800 is fastened to the goggles 804 along the inner surface of the hood 802 with stitching 808. Preferably, the goggles are sewn into an inner lining of the hood 802.

The hooded garment of the present invention is one of a coat, a jacket, a sweatshirt, or any other similar outerwear for inclement weather with a hood. The goggles comprise plastic or some other transparent or shaded eyeglass material. The storable mask of the present invention is of cotton, wool, or any other type of material commonly used in the manufacture of masks. The wearer puts on the storable mask by placing his or her head into the section between the storable mask and the back of the hood through the part of the upside-down U-shaped storable mask that is not fastened to the hood. Similarly, in the embodiment having goggles, the wearer puts on the goggles by placing the goggles over his or head until the goggles rest on the nose of the wearer. The wearer either wears the storable mask or goggles or stores the storable mask or goggles flush against the inside, back of the hood.

Figure 2:
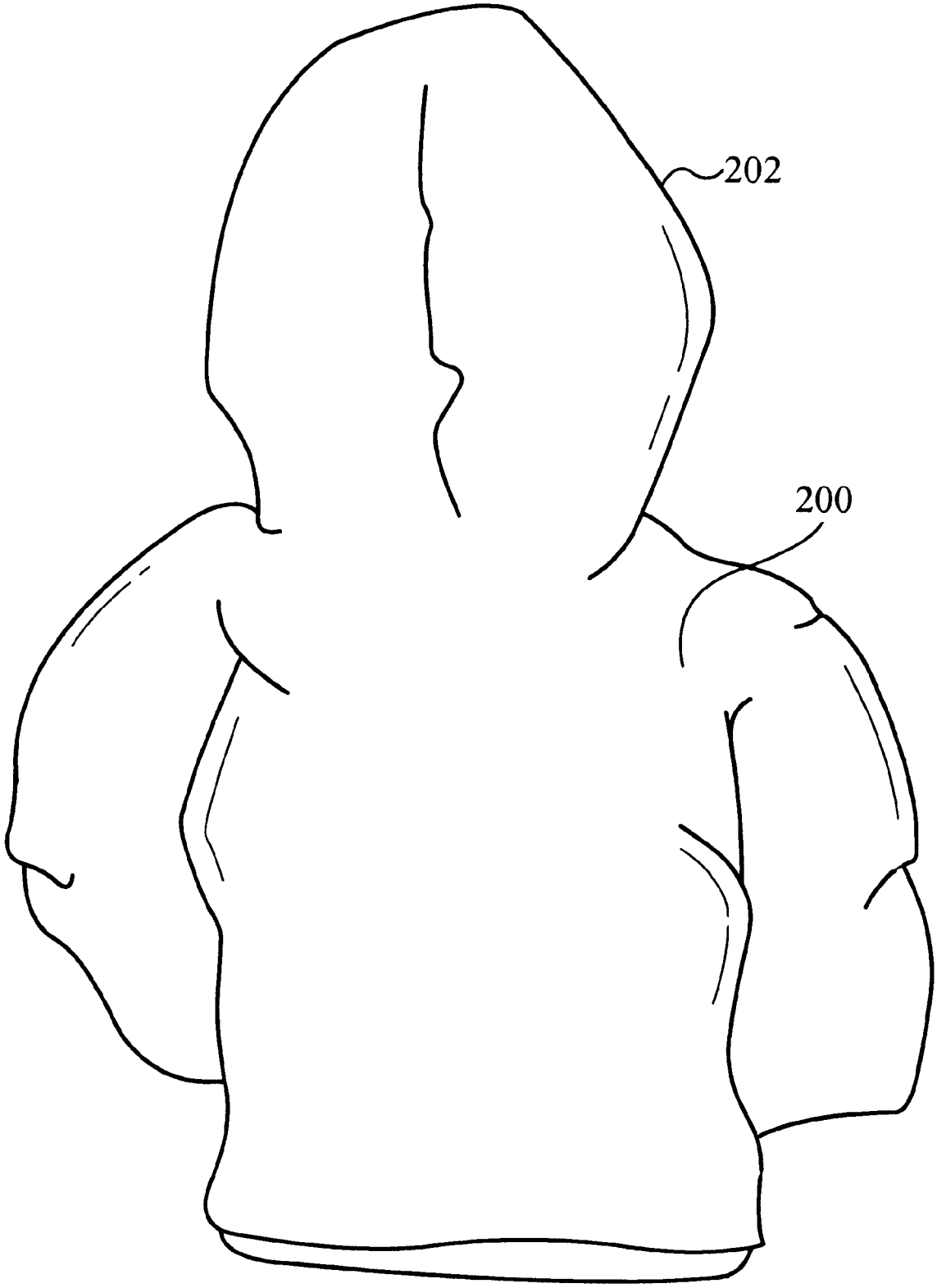
FIG. 2 illustrates a back view of the hooded garment with a storable mask, while the wearer has on the storable mask.
Figure 3:
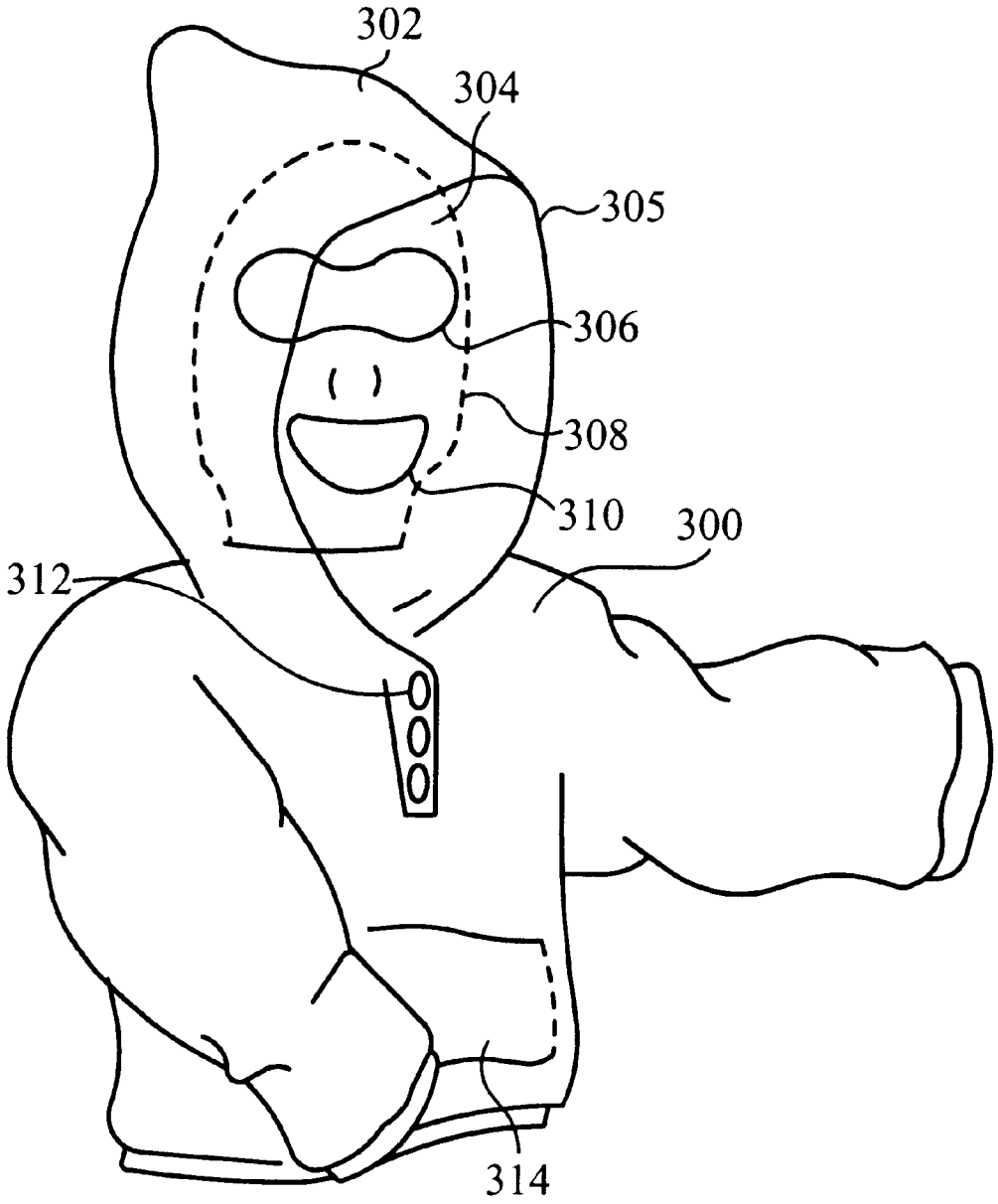
FIG. 3 illustrates a perspective view of the hooded garment with a storable mask, while the wearer has on the storable mask.

FIG. 2 illustrates a back view of the hooded garment with a storable mask, while the wearer has on the storable mask. The hooded garment 200 is connected to the hood 202. FIG. 3 illustrates a perspective view of the hooded garment with a storable mask, while the wearer is wearing the storable mask. The recess from the opening of the hood 305 of the fastening 308 of the storable mask 304 to the hood 302 is shown in good perspective in this illustration of the hooded garment 300. Also shown are the opening 306 for the eyes of the wearer, the additional alternative opening 310 for the mouth of the wearer, the buttons 312, and the pocket 314 of the hooded garment 300.

Figure 4:
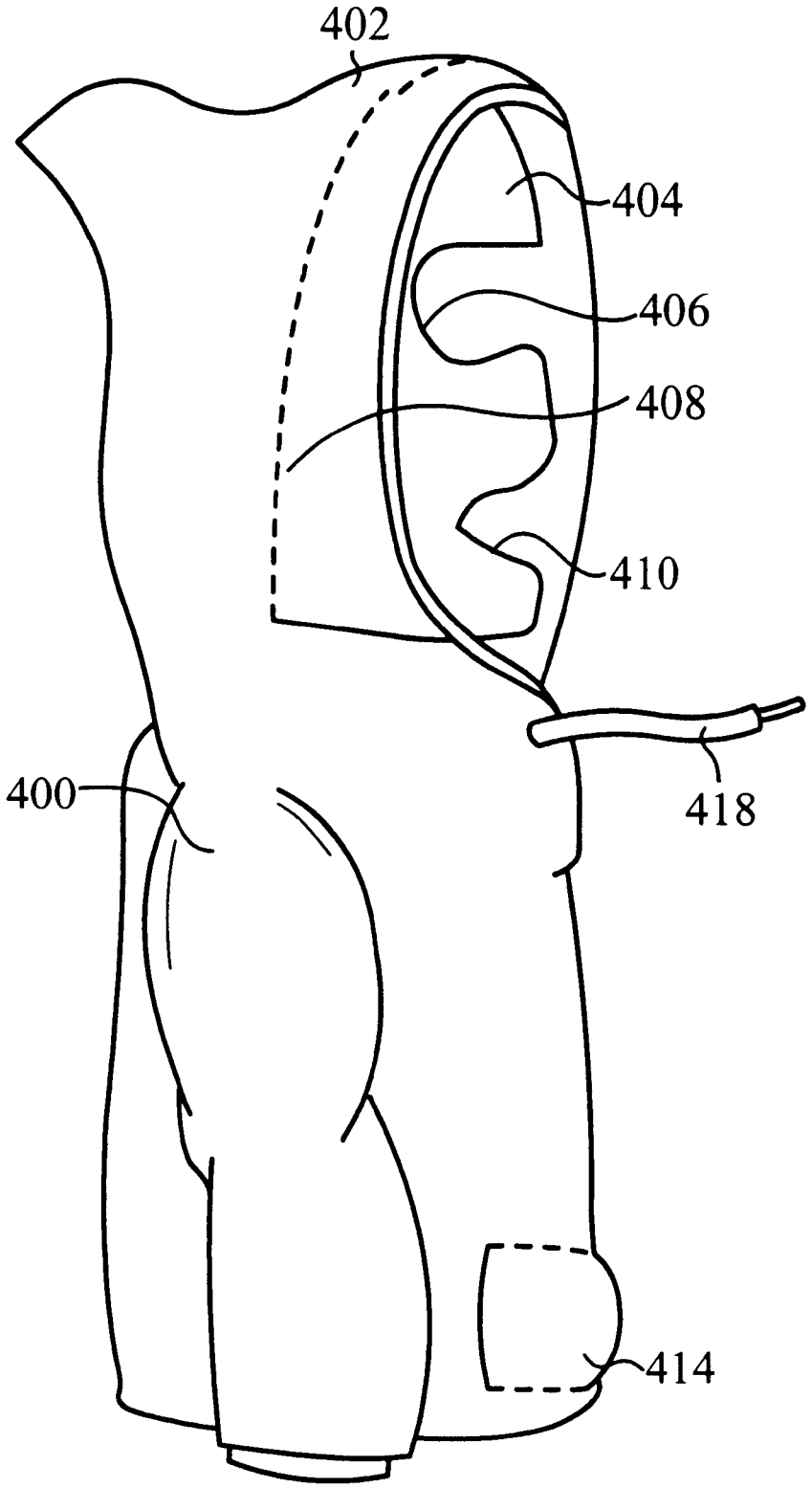
FIG. 4 illustrates a side view of the hooded garment with a storable mask, while the wearer has on the storable mask.

FIG. 4 illustrates a side view of the hooded garment with a storable mask, while the wearer has on the storable mask. The hooded garment 400 has a hood 402, a storable mask 404, a pocket 414, and a drawstring 418. The storable mask 404 is versatile enough to keep as much or as little of the head, face, and neck of the wearer covered, as the wearer desires. The hood 402 and storable mask 404 can be worn loosely, or the drawstring 418 of the hood 402 can be used to tighten the storable mask 404 and hood 402. However, the hood 402 of the hooded garment 400 and the storable mask 404 do not include any cumbersome Velcro, neck straps, or too many drawstrings. Because the present invention has only one drawstring, the chances of children choking due to neck straps, Velcro, or too many drawstrings are greatly decreased. The storable mask 404 has an opening 406 for the eyes of the wearer, the alternative additional opening 410 for the mouth of the wearer, and is sewn 408 to the inner surface of the hood 402 as described above.

Figure 5:
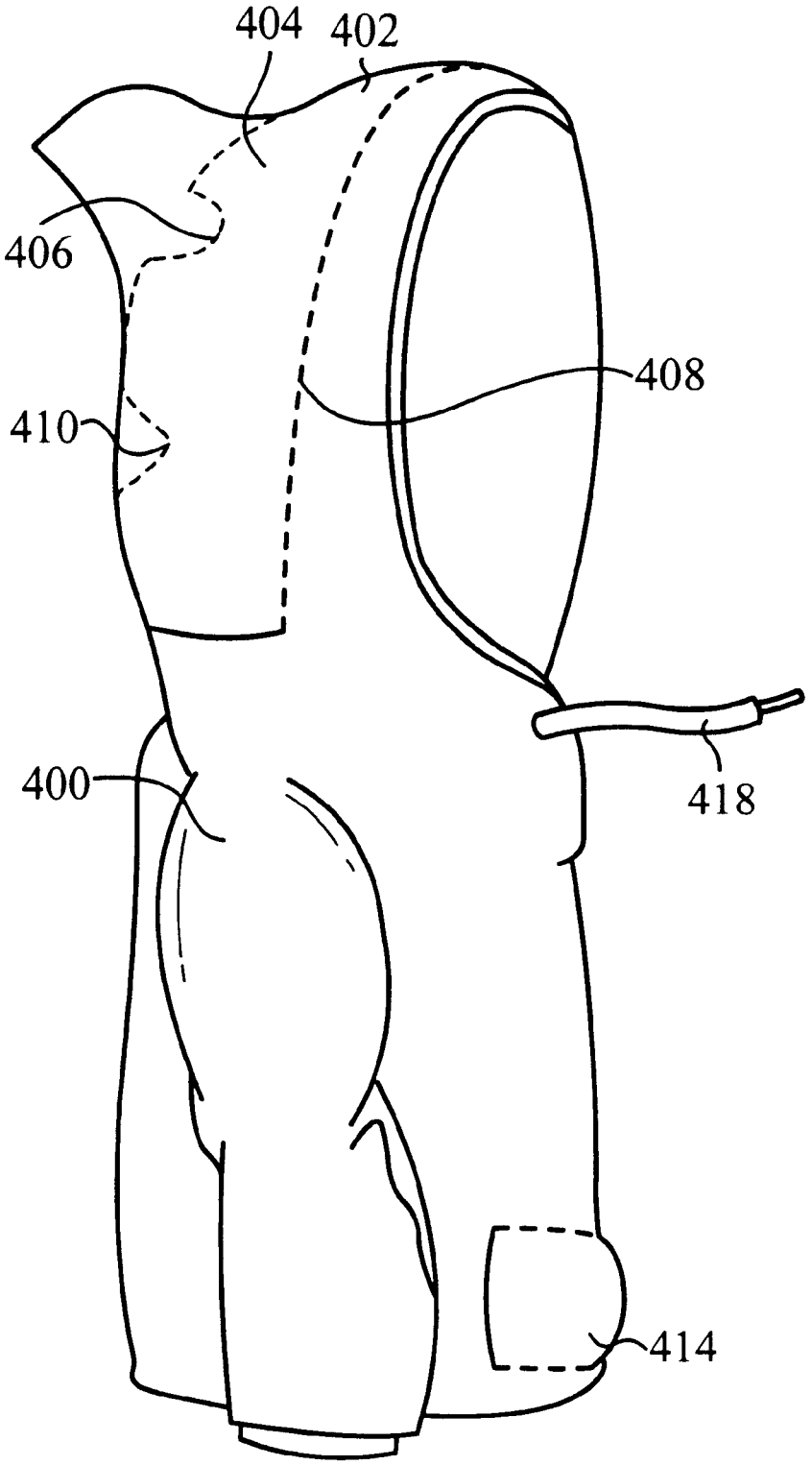
FIG. 5 illustrates a side view of the hooded garment with a storable mask, while the wearer has the storable mask stored.

FIG. 5 illustrates a side view of the hooded garment with a storable mask, while the wearer has the storable mask stored. This illustration show how the storable mask is stored against the inside, back of the hood, behind the head of the wearer. Storing the storable mask in this manner is comfortable for the wearer and convenient to use.

Figure 6:
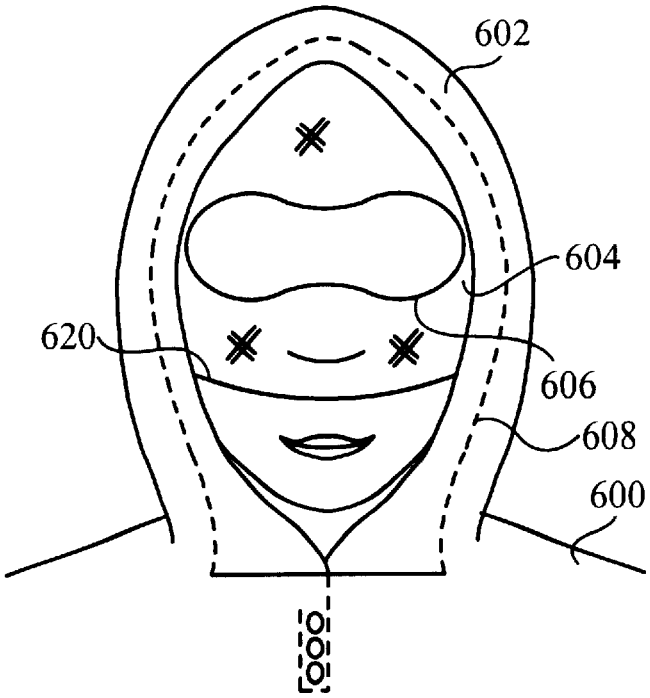
FIG. 6 illustrates a partial front view of the hooded garment with the top half of a split storable mask, while the wearer has on the top half of the storable mask.
Figure 7:
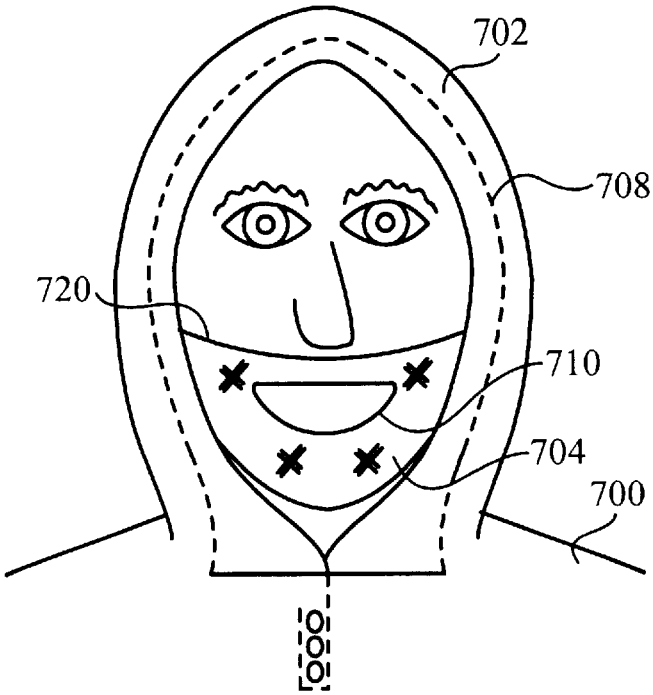
FIG. 7 illustrates a partial front view of the hooded garment with the bottom half of a split storable mask, while the wearer has on the bottom half of the storable mask.

FIGS. 6 and 7 illustrate an alternative embodiment of the storable mask with a mid-separation. In this embodiment, the storable mask includes a horizontal slit, which runs across the middle of the upside-down U-shaped storable mask. This horizontal slit provides the versatility of keeping as much or as little of the head, face, and neck of the wearer covered, as the wearer desires. The wearer may wear only the upper half of the storable mask over the eyes and nose of the wearer, wear only the bottom half of the storable mask over the mouth of the wearer, or wear both halves of the storable mask over the entire face of the wearer. FIG. 6 illustrates a partial front view of the hooded garment, while the wearer has on the top half of the storable mask. In this embodiment of the storable mask 604, the hooded garment 600 has a hood 602, which is fastened to the storable mask 604 along the seam 608. In the illustration of FIG. 6, the bottom half of the storable mask 604 below the horizontal slit 620 is stored in the hood 602 behind the head of the wearer. The top half of the storable mask 604 above the horizontal slit 620 has an opening 606 for both eyes of the wearer.

FIG. 7 illustrates a partial front view of the hooded garment, while the wearer has on the bottom half of the storable mask. In this embodiment of the storable mask 704, the hooded garment 700 has a hood 702, which is fastened to the storable mask 704 along the seam 708. In the illustration of FIG. 7, the bottom half of the storable mask 704 below the horizontal slit 720 has an optional opening 710 for the mouth of the wearer. The top half of the storable mask 704 above the horizontal slit 720 is stored in the hood 702 behind the head of the wearer.

Figure 9:
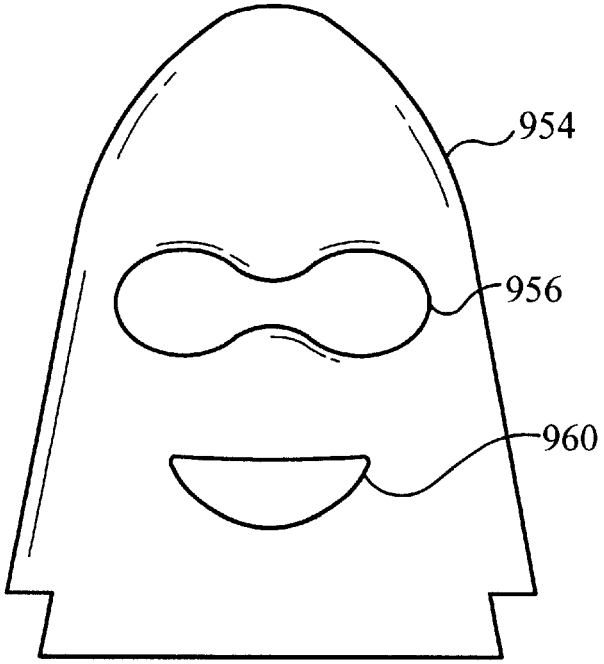
FIG. 9 illustrates a front view of the storable mask.

FIG. 9 illustrates a front view of the storable mask of the preferred embodiment of the present invention. The storable mask 954 preferably has only an opening 956 for both eyes of the wearer. In an alternative embodiment of the present invention, the storable mask 954 includes an opening 960 for the mouth of the wearer.

Figure 10:
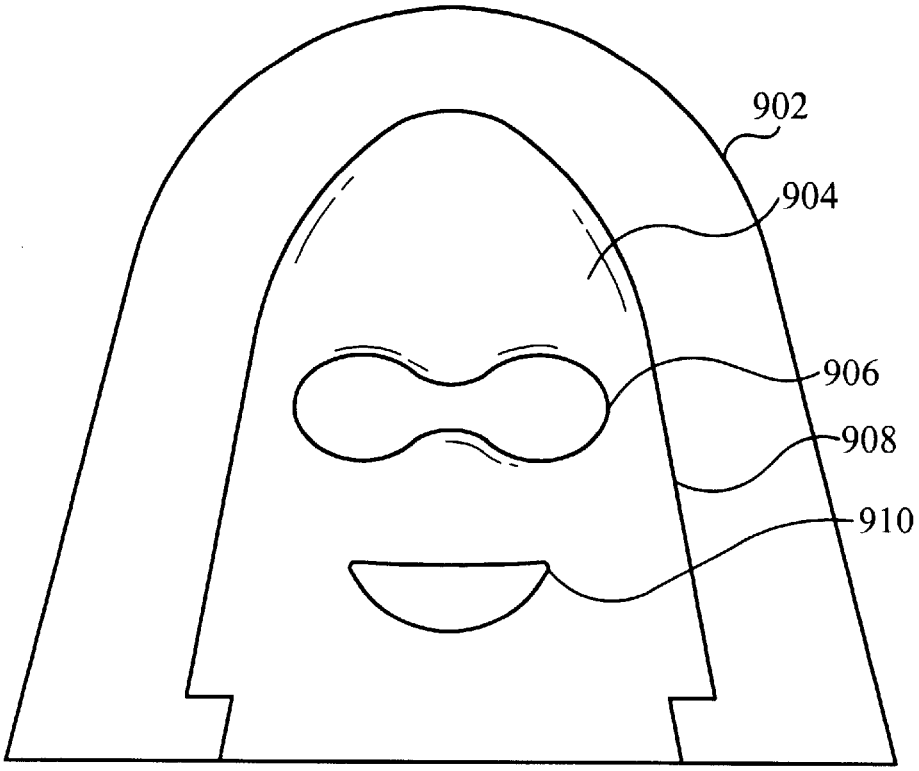
FIG. 10 illustrates a front view of the inner hood of the hooded garment with the storable mask attached.

FIG. 10 illustrates a front view of the inner hood of the hooded garment with the storable mask attached. This illustration shows that the storable mask 904 is fastened 908 to the inner surface of the hood 902 such that the storable mask 904 lies flush with the hood 902 when the hood 902 is laid flat. The storable mask 904 has an opening 906 for both eyes of the wearer and an optional opening 910 for the mouth of the wearer. The storable mask 904 is preferably sewn to the interior lining of the hood 902 during manufacture of the hooded garment of the present invention. Alternatively, the storable mask 904 is attached to the hood in any other appropriate manner including by a zipper or Velcro.

The hooded garment of the preferred embodiment of the present invention has an integral, storable mask sewn into an inner lining of a hood attached to the garment. When worn by a wearer, the mask covers the face of the wearer and protects it against inclement weather. When not worn by a wearer, the storable mask is stored within the hood of the garment behind the head of the wearer. In an alternative embodiment, the integral, storable mask includes a top portion and a bottom portion separated by a horizontal separation. In this embodiment, the wearer can wear either the top portion, the bottom portion, both the top and bottom portions, or neither the top nor the bottom portion. In a further alternative embodiment, the hooded garment includes wearable goggles that can either be worn by the wearer or stored within the hood. The integral, storable mask of the present invention is always within the hood of the hooded garment and available for the wearer of the hooded garment when necessary, making it easy and convenient to keep up with the mask.

The present invention has been described in terms of specific embodiments incorporating details to facilitate the understanding of principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. A method of making a hooded garment having an integral, storable mask comprising the steps of:

a) obtaining a hooded garment having a hood;

b) obtaining a storable mask having an inverted U-shape with a top edge, a bottom edge, a left edge, including a left upper edge and a left lower edge, a right edge, including a right upper edge and a right lower edge, and an opening out of which a wearer can see with both eyes, wherein the left upper edge and the right upper edge both extend from the top edge to a point below a jaw-line of the wearer, and the bottom edge of the mask being flat;

c) attaching the storable mask to an inner surface of the hood along the top, left upper, and right upper edges, thereby leaving the bottom edge, the left lower edge and the right lower edge loose and unattached wherein the storable mask is stored inside the hood when not worn by the wearer.

2. The method according to claim 1, wherein the hooded garment further comprises a button-up neck.

3. The method according to claim 2, wherein the hooded garment further comprises a pocket, centered in a lower front of the hooded garment, having two openings into which the hands of the wearer can be placed.

4. The method according to claim 1, wherein the storable mask further comprises storable goggles.

5. The method according to claim 4, wherein the storable mask is comprised of a selective one of cotton and wool.

6. The method according to claim 1, wherein the storable mask is put on by the wearer by placing a head of the wearer between the storable mask and a back of the hood through the bottom edge of the hood.

7. The method according to claim 1, wherein the storable mask further comprises a horizontal slit across the storable mask separating the storable mask into a bottom portion and a top portion.

8. The method according to claim 1, wherein the step of attaching the storable mask is completed by sewing the storable mask to the inner surface of the hood.

9. An apparatus to protect the torso, arms, neck, and head of a wearer against inclement weather comprising:

a) a hooded garment having a hood with an inner surface and an opening;

b) a storable mask having an inverted U-shape with a top edge, bottom edge, left edge, including a left upper edge and a left lower edge, right edge, including a right upper edge and a right lower edge and an eye opening, wherein the left upper edge and the right upper edge both extend from the top edge to a point below a jaw-line of the wearer and the bottom edge of the mask being flat;

c) means for integrally fastening the storable mask to the inner surface of the hood along the top, left upper, and right upper edges, thereby leaving the bottom edge the left lower edge and the right lower edge loose and unattached, wherein the storable mask is stored inside the hood when not worn by the wearer.

10. The apparatus according to claim 9, wherein the hooded garment further comprises a button-up neck.

11. The apparatus according to claim 10, wherein the hooded garment further comprises one pocket, centered in a lower front of the hooded garment, having two openings into which the hands of the wearer can be placed.

12. The apparatus according to claim 11, wherein the hooded garment further comprises a hood drawstring including two ends, wherein the hood drawstring runs inside material along an edge of the opening of the hood, the two ends of which hang outside of the hooded garment at the neck.

13. The apparatus according to claim 9, wherein the storable mask further comprises storable goggles.

14. The apparatus according to claim 9, wherein the storable mask is comprise of a selective one of cotton and wool.

15. The apparatus according to claim 9, wherein the storable mask further comprises a horizontal slit across the storable mask separating the storable mask into a bottom portion and a top portion.

16. The apparatus according to claim 9, wherein the means for fastening the storable mask to the hooded garment hood includes stitching between the storable mask and the inner surface.

17. A garment to be worn by a wearer comprising:

a) a hood having an interior lining; and b) a storable mask having an inverted U-shape with a top edge, bottom edge, left edge, including a left upper edge and a left lower edge, and an eye opening, wherein the left upper edge and the right upper edge both extend from the top edge to a point below a jaw-line of the wearer and the bottom edge of the mask being flat, wherein the storable mask is coupled to the interior lining along the top edge, the left upper edge and the right upper edge, thereby leaving the bottom edge, the left lower edge and the right lower edge loose and unattached, wherein the storable mask is stored inside the hood when not worn by the wearer.

18. The garment according to claim 17, wherein the storable mask further comprises a mouth opening.

19. The garment according to claim 17, wherein the storable mask includes a horizontal separation separating the storable mask into a bottom portion and a top portion.

20. An apparatus to protect torso, arms, neck and head of a wearer against inclement weather comprising:

a) a hooded garment having a hood with an inner surface and an opening;

b) a storable mask having an inverted U-shape with a top edge, bottom edge, an eye opening, a left edge having a left bottom portion and a left top portion, and a right edge having a right bottom portion and a right top portion, wherein the left top portion and a right edge having a right bottom portion and a right top portion, wherein the left top portion and the right top portion extend from the top edge to a point below a jaw-line of the wearer and the bottom edge of the mask being flat;

c) a fastening apparatus for integrally fastening the storable mask to the inner surface of the hood along the top edge, the left top portion and the right top portion, thereby leaving the left bottom portion and the right bottom portion loose and unattached, wherein the storable mask is stored inside the hood when not worn by the wearer.

21. An apparatus to protect torso, arms, neck and head of a wearer against inclement weather comprising:

a) a hooded garment having a hood with an inner surface and an opening;

b) a storable mask having an inverted U-shape with a top edge, bottom edge, and eye opening, a left edge having a left bottom portion and a left top portion, and a right edge having a right bottom portion and a right trop portion, the right bottom portion and the left bottom portion being flat; and c) a fastening apparatus for integrally fastening the storable U-shaped mask to the inner surface of the hood along the top edge, the left top portion and the right top portion, thereby leaving the left bottom portion and the right bottom portion loose and unattached, wherein the storable mask is stored inside the hood when not worn by the wearer.

22. An apparatus to protect torso, arms, neck and head of a wearer against inclement weather comprising:

a) a hooded garment having a hood with an inner surface and an opening;

b) a storable mask, having a top edge, bottom edge, and eye opening, a left edge, a right edge and a horizontal slit across the storable mask separating the storable mask into a bottom portion and a top portion;

c) a fastening apparatus for integrally fastening the storable mask to the inner surface of the hood such that the wearer has ability to selectively position the bottom portion and the top portion in front of a wearer's face.

23. The apparatus according to claim 22 wherein the bottom portion and the top portion are stored inside the hood when not positioned in front of the wearer's face.

24. The method according to claim 1, wherein the step of attaching includes permanently attaching the storable mask to the inner surface of the hood.

* * * * *

UNITED STATES PATENT AND TRADEMARK OFFICE

CERTIFICATE OF CORRECTION

PATENT NO. : 6,397,395 B1
DATED : June 4, 2002
INVENTOR(S) : DeHart

It is certified that error appears in the above-identified patent and that said Letters Patent is hereby corrected as shown below:

Title page,
Item [56], References Cited, U.S. PATENT DOCUMENTS, at reference No. 5,551,087, delete "Bluestein et al." and replace with -- Blutstein et al. --.

Column 6,
Line 54, delete "comprise" and replace with -- comprised --.

Column 8,
Line 6, delete "trop" and replace with -- top --.

Signed and Sealed this

Tenth Day of September, 2002

*Attest:*

*Attesting Officer*

JAMES E. ROGAN
*Director of the United States Patent and Trademark Office*